US005460541A

United States Patent [19]

Weatherley

[11] Patent Number: 5,460,541

[45] Date of Patent: Oct. 24, 1995

[54] JACK SOCKET ASSEMBLY

[76] Inventor: Richard Weatherley, 23/25 Tenter Road, Northampton, NN3 6AX, United Kingdom

[21] Appl. No.: 153,947

[22] Filed: Nov. 18, 1993

[30] Foreign Application Priority Data

Nov. 18, 1992 [GB] United Kingdom ..... 9224154

[51] Int. Cl.[6] ..... H01R 13/518

[52] U.S. Cl. ..... 439/532

[58] Field of Search ..... 439/532, 540, 439/553, 554, 701

[56] References Cited

U.S. PATENT DOCUMENTS

| | | | |
|---|---|---|---|
| 4,390,230 | 6/1983 | Knickerbocker | 439/532 |
| 4,731,925 | 3/1988 | Tanishi et al. | 29/840 |
| 4,767,338 | 8/1988 | Dennis et al. | 439/532 |
| 4,773,867 | 9/1988 | Keller et al. | 439/532 |
| 4,894,024 | 1/1990 | Debortoli et al. | 439/535 |
| 5,002,497 | 3/1991 | Plocek et al. | 439/248 |
| 5,173,061 | 12/1992 | Comerci et al. | 439/536 |

FOREIGN PATENT DOCUMENTS

| | | |
|---|---|---|
| 0487893 | 6/1992 | European Pat. Off. . |
| 2240672 | 8/1991 | United Kingdom . |

*Primary Examiner*—Gary F. Paumen

*Attorney, Agent, or Firm*—Watson, Cole, Grindle & Watson

[57] ABSTRACT

A jack socket assembly (20) includes a face plate (21) to which a jack socket module (27) is secured by a clip (26). The jack socket module comprises a printed circuit board (28), a jack socket (29) secured to the printed circuit board and terminal blocks (30). In addition to being usable in the jack socket assembly (20), the same module may be used in rack equipment, provided that a suitable clip is used to secure it to a mounting plate. Individual jack socket modules (27) can readily be removed and replaced as necessary.

8 Claims, 3 Drawing Sheets

JACK SOCKET ASSEMBLY

BACKGROUND OF THE INVENTION

This invention relates to a jack socket assembly comprising a mounting plate adapted to be secured to a support structure and a jack socket secured to the mounting plate.

Jack socket assemblies are commonly used in communications and data processing systems to provide a releasable connection for cables for transferring signals between two pieces of equipment.

Jack socket assemblies can be divided into two separate types. Firstly, there is the type of socket assembly incorporated into a piece of equipment to provide for the connection of a jack plug to that piece of equipment. Typically, several jack sockets may be located in a side by side relationship on the piece of equipment. In such installations of the prior art a jack socket is typically secured to a mounting plate which forms part of the equipment by releasable fasteners, for example screws. In the event that the socket develops a fault, it can be removed and replaced by a new socket. Secondly, there is the type of jack socket assembly used to provide a connection between a piece of equipment and a permanent wiring system laid out in a building. Such jack sockets provide a convenient terminal for connection, e.g., of a telephone to a telephone wiring system or a computer to a network system. In jack socket assemblies of this type a jack socket is in general permanently secured to a plastics face plate or is an integral part of the face plate. If such a jack socket develops a fault, the entire assembly is in general thrown away and replaced by a new assembly complete with new face plate and jack socket.

It will be appreciated that the jack socket utilised in the first type of assembly cannot be utilised in the second type of assembly, and visa versa.

SUMMARY OF THE INVENTION

The object of the present invention is to provide a jack socket assembly in which a jack socket module is secured to a mounting plate by means of a plastic clip. By providing a range of different plastic clips, a common jack socket module may be secured optionally either to a mounting plate of the type found in pieces of equipment or to a face plate of a type suitable for use in the permanent wiring system of a building. Hence, the need to provide separate designs of jack socket for these two types of jack socket assembly is removed.

Accordingly, the present invention provides a jack socket assembly comprising: a mounting plate adapted to be secured to a support structure; a plastic clip secured to the mounting plate; and a jack socket module comprising a printed circuit board having mounted thereon a jack socket and at least one wire-receiving terminal, the jack socket module being releasably secured to the mounting plate by the plastic clip.

In addition to enabling a common design of jack socket module to be used with a range of different mounting plates, the present invention, by making use of a clip to releasably secure the jack socket module to the mounting plate, enables the jack socket module to be removed from the mounting plate for replacement. The use of a plastic clip rather than screws considerably simplifies the removal and replacement of jack sockets in the first type of installation outlined above. The use of a releasable clip to secure the jack socket module to the face plate of the second type of assembly referred to above enables the jack socket to be replaced in the event of a fault or in the event of a change of installation without replacing the face plate portion of the assembly.

According to another aspect of the present invention a method of securing a jack socket module comprising a printed circuit board having mounted thereon a jack socket and at least one wire-receiving terminal to either of two different types of mounting plate comprises: providing for each mounting plate a plastic clip which is, in use, secured to the respective mounting plate, each clip providing means for releasably securing the jack socket module thereto; and selectively releasably securing the jack socket module to one of the clips.

The jack socket modules employed in the present invention can be manufactured as individual modules, each comprising one jack socket and associated terminals, together with any other components required. However, the jack socket modules of the present invention are preferably manufactured in strips comprising a plurality of modules located in side-by-side configuration. The interconnections between each module are frangible so that a strip of modules can be broken as desired to provide individual modules, or small groups of modules. Thus, if a particular installation of the first type requires four side-by-side jack sockets, a strip of four sockets may be broken from the longer strip and clipped, as a group of four, to the four clips provided on the mounting plate. The alternative, two pairs of two jack socket modules may be utilised or four individual modules utilised. In the event that it is necessary to change one of the modules, it can simply be unclipped (if it is an individual module) or the group of modules can be unclipped and at that stage broken to remove the particular module requiring replacement, and an individual module can then be used to replace that which has been removed.

It will be appreciated that the present invention provides considerable flexibility in both original equipment manufacture, servicing, and up-grading of electronic equipment utilising jack socket assemblies.

The invention will be better understood from the following description of a preferred embodiment thereof, given by way of example only, reference being had to the accompanying drawings.

DETAILED DESCRIPTION OF THE PREFERRED EMBODIMENTS

Figure 1:
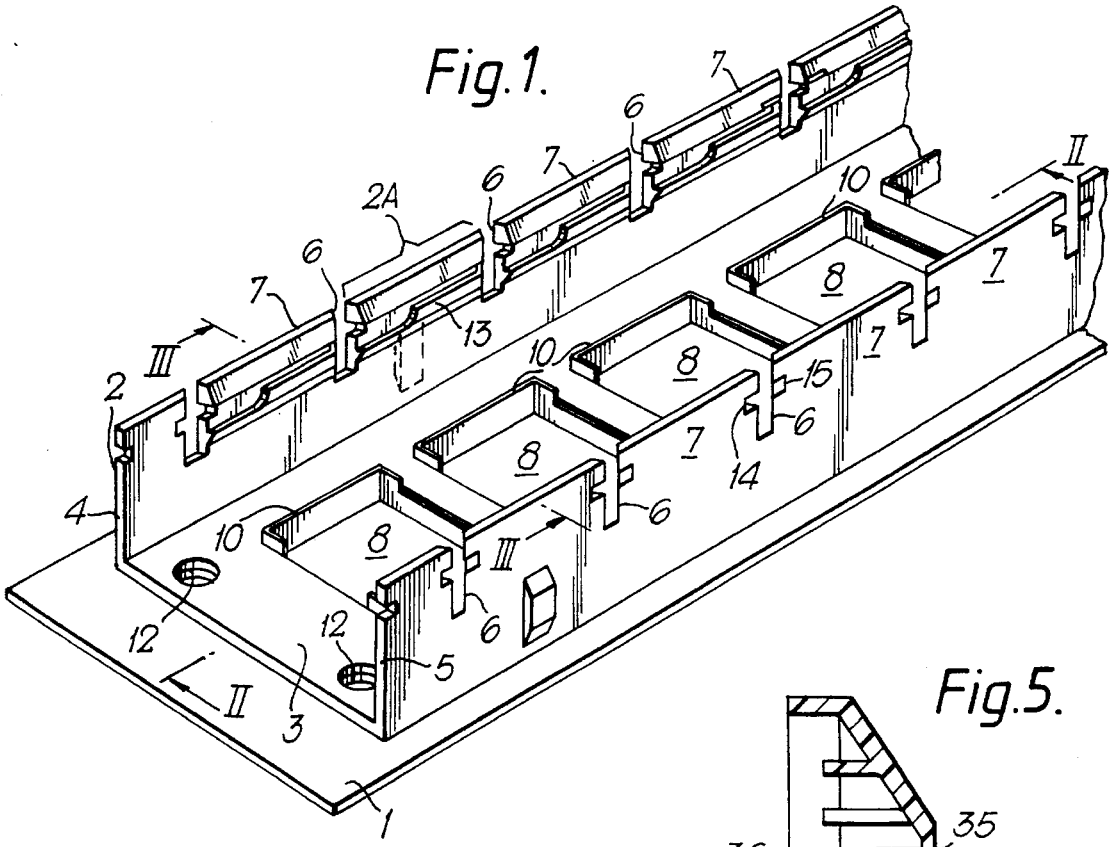
FIG. 1 schematically illustrates a rear view of a mounting plate and clip of a jack socket assembly of a first type.

Referring firstly to FIG. 1, there is shown schematically a rear view of a mounting plate 1 which is adapted to form part of a piece of electrical or electronic equipment. FIG. 1 illustrates the mounting plate from the rear: from the front the mounting plate will present a plurality of apertures through which jack plugs can be inserted to engage sockets secured behind the mounting plate. In use, the mounting plate itself is secured to the chassis of the equipment utilising mounting hole.

In the alternative, the mounting plate may be an integral part of the face plate of the equipment.

A plastic clip 2 is secured to the mounting plate 1 by suitable means. A plastic clip 2 comprises a series of clip portions 2A arranged end to end as an integral moulding. If desired, lines of weakness may be provided between adjacent clip portions to enable individual clip portions or groups of clip portions to be broken from the moulding as required.

The clip 2 is generally U-shaped in transverse cross-section and comprises a base 3 and upstanding arms 4,5. Vertical slots 6 divide the arms 4,5 into individual tongue-like projections 7. Each clip portion 2A comprises a pair of mutually opposed tongue-like projections 7 and the portion the base 3 located therebetween. The base 3 is formed with the plurality of apertures 8 each surrounded, on the underside of the clip 2 as viewed in FIG. 1, by a depending wall 9. The outer periphery of the depending wall 9 is a snug fit within a corresponding aperture provided in the mounting plate 1 so that, when viewed from the front of the mounting plate, the assembly presents a plurality of apertures each surrounded by a respective wall 9.

On the upper side of the base, as viewed in FIG. 1, the apertures are surrounded in part by a pair of generally U-shaped walls 10,11. If desired, a metal reinforcing plate may be provided to lie inside the clip 2 against the base 3 with the wall portions 10,11 extending through apertures provided in the reinforcing plate to locate the reinforcing plate in position. The reinforcing plate may then be secured to the mounting plate by suitable means, for example bolts passing through apertures 12 whereby the base 3 of the clip is sandwiched between the mounting plate 1 and the reinforcing plate. This provides a particularly rigid and robust way of mounting the clip 2 on the mounting plate 1. Further, the walls 9,10,11 substantially reduce the possibility that a contact of a jack plug will come into accidental contact with the mounting plate 1 or the reinforcing plate (if present) as the plug is inserted through the aperture.

Each of the tongue-like projections 7 defines a groove 13, the grooves of each opposed pair of tongue-like projections 7 being mirror images one of the other. At each slot 6 a pair of cut-out portions 14, 15 extend into the material of the tongue-like projections 7 at the level of the grooves 13.

Figure 5:
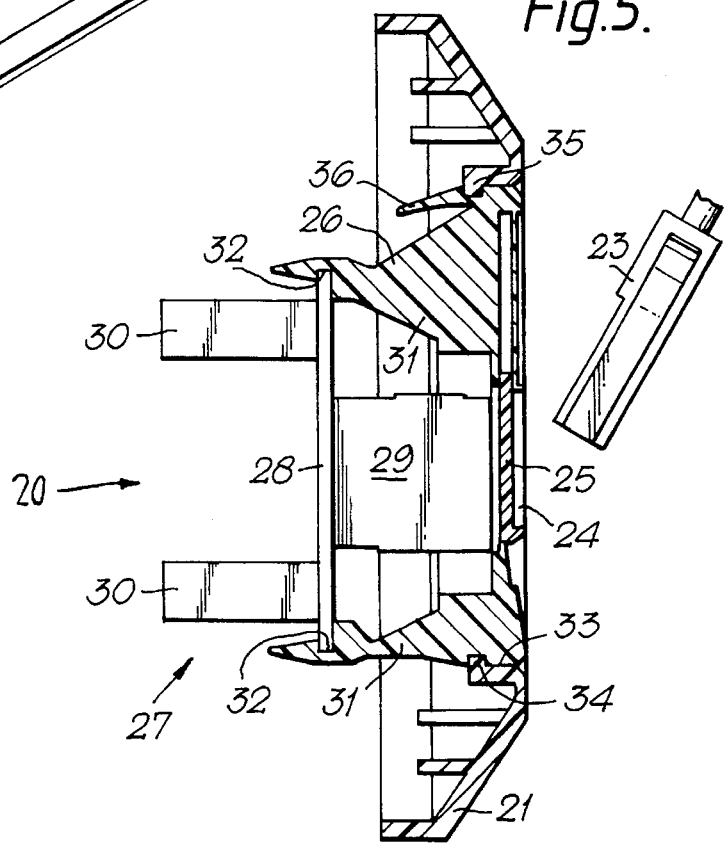
FIG. 5 is a cross sectional view of the embodiment of FIG. 4 illustrating schematically the components thereof.
Figure 2:
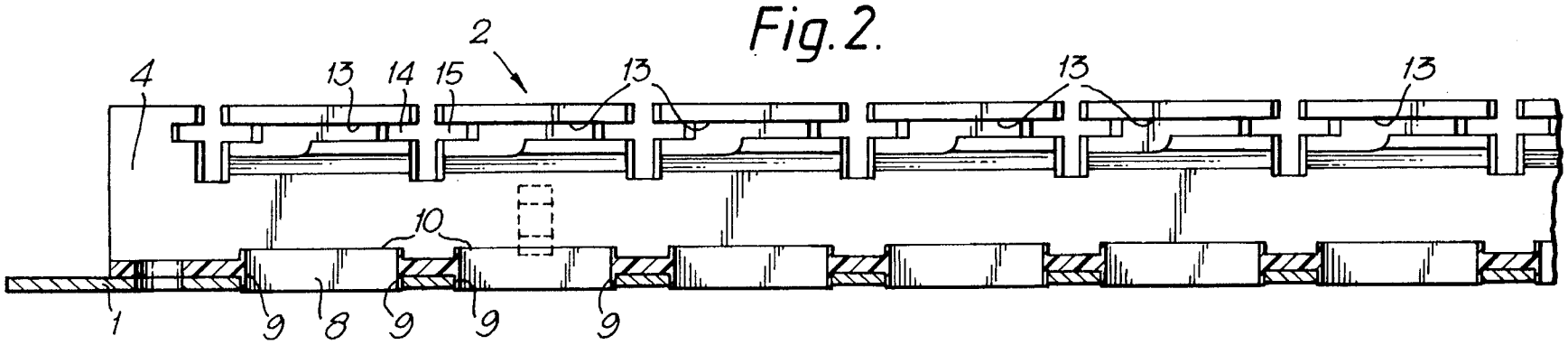
FIG. 2 is a cross-section on the line II—II of FIG. 1.
Figure 4:
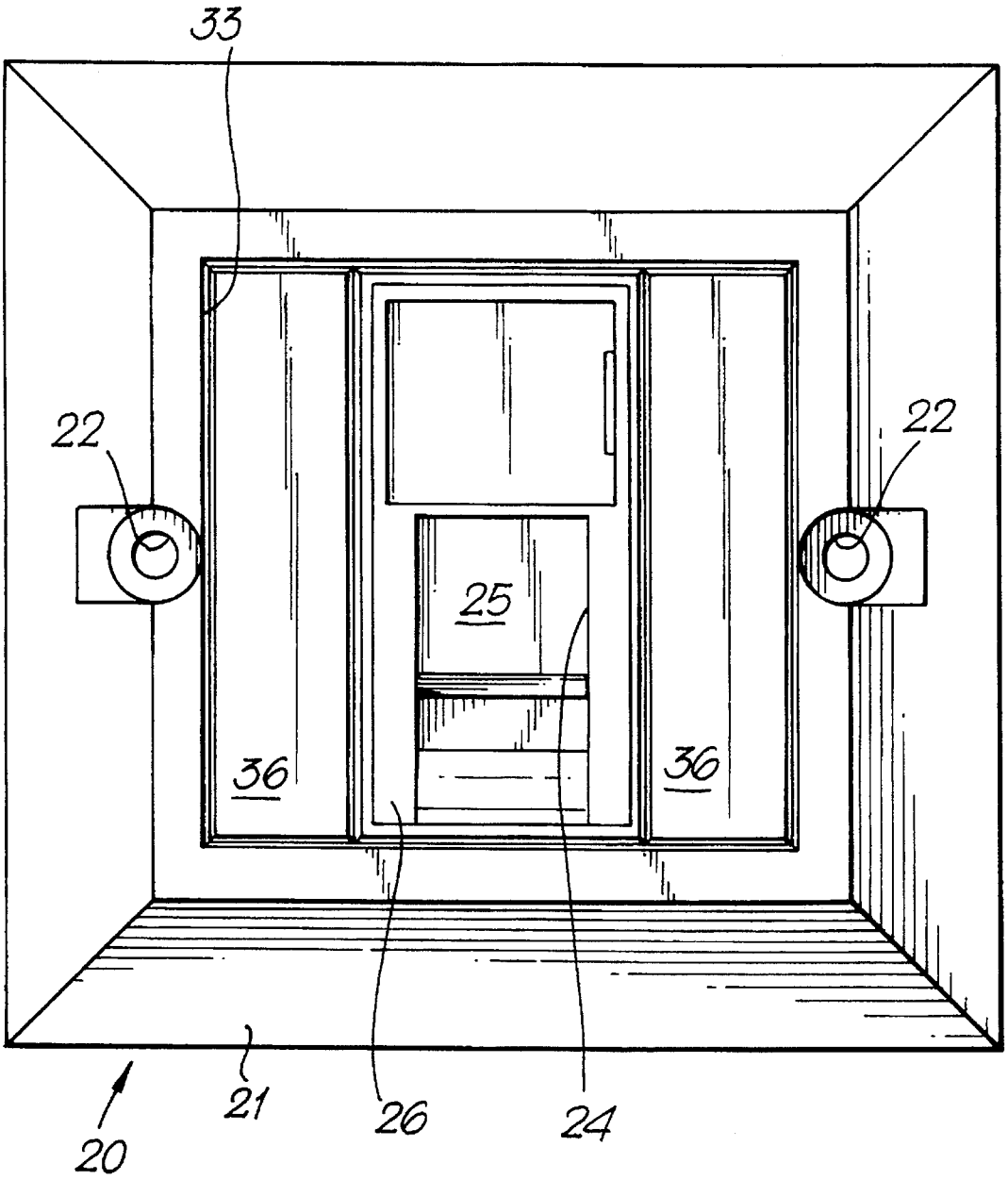
FIG. 4 schematically illustrates a front view of a jack socket assembly of a second type.

Referring now to FIGS. 4 and 5 there is illustrated a jack socket assembly 20 comprising a mounting plate 21 in the form of a face plate adapted to be secured to a mounting box by means of screws passing through holes 22. The jack socket 20 is adapted to provide an outlet from a permanent wiring system of a building or the like to enable a jack plug 23 to be connected to that permanent wiring system. When viewed from the front (as in FIG. 4) the assembly provides an opening 24 through which a jack plug may be inserted to engage a jack socket located behind the face plate 21. As is conventional, the opening is closed by a vertically moveable door 25 which may be raised to permit insertion of a jack plug.

Referring more particularly to FIG. 5 the illustrated jack socket assembly 20 comprises, in addition to the face plate 21, a clip 26 moulded from suitable plastic material. A jack socket module 27 comprising a printed circuit board 28, a jack socket 29 and a pair of terminal blocks 30 is secured to the clip 26 so that the jack socket is presented to the opening 24 to receive the jack plug 23 pushed through the aperture.

Figure 3:
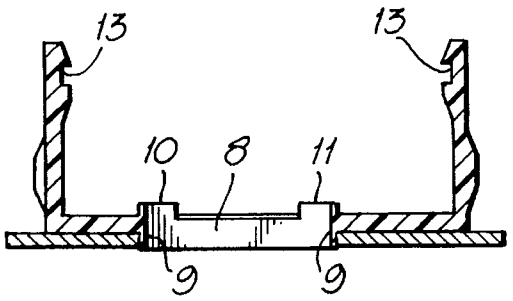
FIG. 3 is a cross-section on the line III—III of FIG. 1.

The clip 26 includes a pair of legs 31, each of which defines a groove 32. The form and spacing of the grooves 32 is the same as that of the grooves 13 of the clip 2 of FIG. 1. Also, the disposition of the grooves 32 relative to the opening 24 of the clip 26 is the same as the disposition of the grooves 13 relative to the apertures 8 of the clip 2 of FIG. 1. As shown in FIG. 3, the jack socket module 27 illustrated in FIG. 5 can, without modification, be secured to the clip 2 for utilisation with the jack socket assembly of FIG. 1.

In order to assemble the jack socket assembly 20 of FIG. 5, a clip 26 is offered up and pushed through an opening 33 defined by the face plate 21. A projection 34 provided on one side of the opening 33 is engaged in a corresponding groove provided in the clip and the clip is then pushed home, whereupon a projection 35 on the opposite side of the opening 33 snaps into engagement with a corresponding groove provided in the clip. To assist in insertion of the clip and facilitate removal thereof a deformable barb member 36 is integrally formed with the clip. As the clip is pushed into position the barb member 36 is cammed downwardly as illustrated in FIG. 5 to enable the projection 35 to snap into the corresponding groove.

It will be noted that the projections 34,35 on opposite sides of the opening 33 are identical to each other and accordingly the clip may be engaged with the face plate 21 either way up relative to the face plate itself.

The opening 33 in the face plate is large enough to accommodate two clips 26 side-by-side. Accordingly, two jack sockets can be provided by an individual face plate. If only one jack socket is provided a pair of half width blanking plates 36 may be provided on either side of the clip 26 to occupy the unused portion of the opening.

The jack socket module 27 is snap fitted into the grooves 32 either before or after the clip 26 is secured to the face plate. If it is desired to remove the jack socket module 27 from the clip, this can readily be accomplished by springing apart the legs 31 to facilitate release of the module.

In the case of the jack socket assembly of FIG. 1 a plurality of jack socket modules are mounted side-by-side so that a jack socket is presented to each of the apertures 8. The jack socket modules may be joined together edge-to-edge as a single strip, or may be individual modules. In either event, the modules preferably include projections which mate with the cut-out portions 14,15 to prevent lateral movement of the modules relative to the clip 2 and to resist accidental removal of the modules as a result of flexing of the clip. As with the embodiment of FIG. 5, if a module requires replacement, it can readily be unclipped by flexing apart the tongue-like projections 7.

It will be appreciated from the above that the invention provides an arrangement whereby a universal jack socket module may be used to provide a face plate type jack socket or a panel mounted type jack socket. However, in either case the clip facilitates ready assembly of the jack socket module with its mounting structure and readily removal of the jack socket module if required. Further, by utilising an arrangement illustrated in FIG. 5, a single face plate may provide one or more jack socket outlets.

I claim:

1. A jack socket assembly comprising: a mounting plate adapted to be secured to a support structure, the mounting plate having an aperture for passage of a jack plug; a plastic clip secured to the mounting plate, the plastic clip being generally U-shaped in transverse cross-section with a base and a pair of upstanding legs, the base having an aperture for the passage of a jack plug and the legs being resiliently deformable; a jack socket module comprising a printed circuit board having mounted thereon a jack socket for receiving a jack plug and at least one wire-receiving terminal; and inter-engaging means on the legs of the clip and on the printed circuit board whereby the jack socket module may be mounted on the clip by cooperation of the inter-engaging means of the printed circuit board and the legs of the clip to position the jack socket to receive a jack plug therein which is inserted through the aperture in the mounting plate and through the aperture in the clip base, and whereby the jack socket module may be removed from the clip by flexing the legs of the clip to disengage the inter-engaging means.

2. A jack socket assembly according to claim 1, wherein the inter-engaging means comprise opposing grooves on the legs of the clip for receiving opposed edge portions of the printed circuit board.

3. A jack socket assembly according to claim 2, wherein cut-out portions are provided at each end of each said groove to prevent lateral movement of the jack socket module relative to the clip.

4. A jack socket assembly to claim 1 wherein said clip defines a plurality of integrally formed adjacent clip portions each comprising a pair of tongue-like projections adapted to receive said jack socket module therebetween, the base of the clip being formed with a plurality of apertures whereby one of said apertures is associated with each pair of tongue-like projections whereby a jack plug may be inserted through each aperture of said clip for mating engagement with the respective jack socket located therebehind.

5. A jack socket assembly according to claim 4 wherein a plurality of said jack socket modules are secured to said clip, said jack socket modules being in the form of a strip which is frangible to separate individual modules if required.

6. A jack socket module according to claim 1 wherein the mounting plate is a plastic face plate adapted to be secured to a mounting box from the front thereof, the face plate defining an opening in which the clip is located.

7. A jack socket assembly according to claim 6 wherein said opening is large enough to receive two clips whereby the assembly can provide two side-by-side jack sockets.

8. A jack socket assembly according to claim 7 wherein a single clip is mounted in said opening and one or more blanking plates cover the remainder of the opening.

* * * * *